US011296448B2

(12) United States Patent
Xu et al.

(10) Patent No.: US 11,296,448 B2
(45) Date of Patent: Apr. 5, 2022

(54) ELECTRICAL CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Guang-Lei Xu, Kunshan (CN); Zhi-Bin Zhao, Kunshan (CN); Hung-Chi Yu, New Taipei (TW); Wen-Jun Tang, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/093,281

(22) Filed: Nov. 9, 2020

(65) Prior Publication Data

US 2021/0143570 A1 May 13, 2021

(30) Foreign Application Priority Data

Nov. 9, 2019 (CN) ..... 201911090691.8

(51) Int. Cl.
*H01R 13/11* (2006.01)
*H01R 13/04* (2006.01)
(Continued)

(52) U.S. Cl.
CPC ..... *H01R 13/113* (2013.01); *H01R 13/04* (2013.01); *H01R 13/405* (2013.01);
(Continued)

(58) Field of Classification Search
CPC .. H01R 13/5227; H01R 13/113; H01R 13/04; H01R 13/405; H01R 13/502; H01R 13/629; H01R 13/64; H01R 2107/00
(Continued)

(56) References Cited

U.S. PATENT DOCUMENTS 8,038,466 B1 * 10/2011 Tai ..... H01R 12/7082 439/485
8,662,913 B2 * 3/2014 Tai ..... H01R 13/50 439/345

(Continued)

*Primary Examiner* — Gary F Paumen
(74) *Attorney, Agent, or Firm* — Ming Chieh Chang; Wei Te Chung

(57) ABSTRACT

A receptacle connector includes an insulative housing having an upper wall and a lower wall with a plurality of vertical walls linked therebetween to form corresponding passageways alternately arranged with the vertical walls. A plurality of contacts are disposed in the corresponding passageways, respectively. A plurality of upper apertures are formed in the upper wall to communicate with the corresponding passageways. A plug connector is adapted to be mated with the receptacle connector and includes an insulative body with opposite top wall and bottom wall. A plurality of through openings are formed in the top wall. A plurality of grooves are formed in an interior face of the top wall to communicate the through openings of the plug connector with the corresponding apertures of the receptacle connector.

18 Claims, 18 Drawing Sheets

(51) Int. Cl.

| | |
|---|---|
| ***H01R 13/405*** | (2006.01) |
| ***H01R 13/502*** | (2006.01) |
| ***H01R 13/629*** | (2006.01) |
| ***H01R 13/64*** | (2006.01) |
| ***H01R 107/00*** | (2006.01) |

(52) U.S. Cl.
CPC ..... *H01R 13/502* (2013.01); *H01R 13/629* (2013.01); *H01R 13/64* (2013.01); *H01R 2107/00* (2013.01)

(58) Field of Classification Search
USPC ..... 439/485, 206
See application file for complete search history.

(56) References Cited

U.S. PATENT DOCUMENTS

2007/0293084 A1* 12/2007 Ngo ..... H01R 12/7088 439/552
2008/0318464 A1* 12/2008 Yuan ..... H01R 13/447 439/485
2011/0287658 A1* 11/2011 Yu ..... H01R 12/7088 439/485
2012/0164874 A1* 6/2012 Yu ..... H01R 12/716 439/485
2016/0064837 A1* 3/2016 Yu ..... H01R 13/41 439/374

* cited by examiner

ELECTRICAL CONNECTOR ASSEMBLY

BACKGROUND OF THE INVENTION

1. Field of the Invention

The present invention relates generally to an electrical contact assembly, and particularly to the receptacle connector for use with high power/speed transmission.

2. Description of Related Arts

The high power/speed transmission of electrical connector assembly requires relatively superior heat dissipation compared with the traditional electrical connector assembly.

It is desired to provide a receptacle connector with superior heat dissipation effect when mated with the plug connector.

SUMMARY OF THE INVENTION

To achieve the above object, an electrical connector assembly includes the receptacle connector and the plug connector mated with each other. The receptacle connector includes an insulative housing and a plurality of contacts retained therein. The insulative housing includes an upper wall and a lower wall each extending along a longitudinal direction and opposite to each other in a vertical direction perpendicular to the longitudinal direction, and a plurality of partition/vertical walls linked between the upper wall and the lower wall. A passageway is formed between every adjacent two partition walls. A plurality of contacts are retained in the housing. Each contact includes a contacting section received in the corresponding passageway, and a connecting section on a rear side of the housing. Each vertical wall forms an upper recess around the upper wall to have the two corresponding neighboring passageways communicate with each other in the longitudinal direction around the upper wall. The upper wall forms a plurality of upper through holes and communicatively aligned with the corresponding upper recesses, respectively, in the vertical direction. Similarly, each vertical wall forms a lower recess around the lower wall to have the two corresponding neighboring passageways communicate with each other in the longitudinal direction around the lower wall. The lower wall forms a plurality of lower through holes and communicatively aligned with the corresponding lower recesses, respectively, in the vertical direction. Therefore, a heat transfer path is formed by the upper/lower recesses and the upper/lower through holes to efficiently dissipate heat from the passageway to an outside of the housing.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 16:
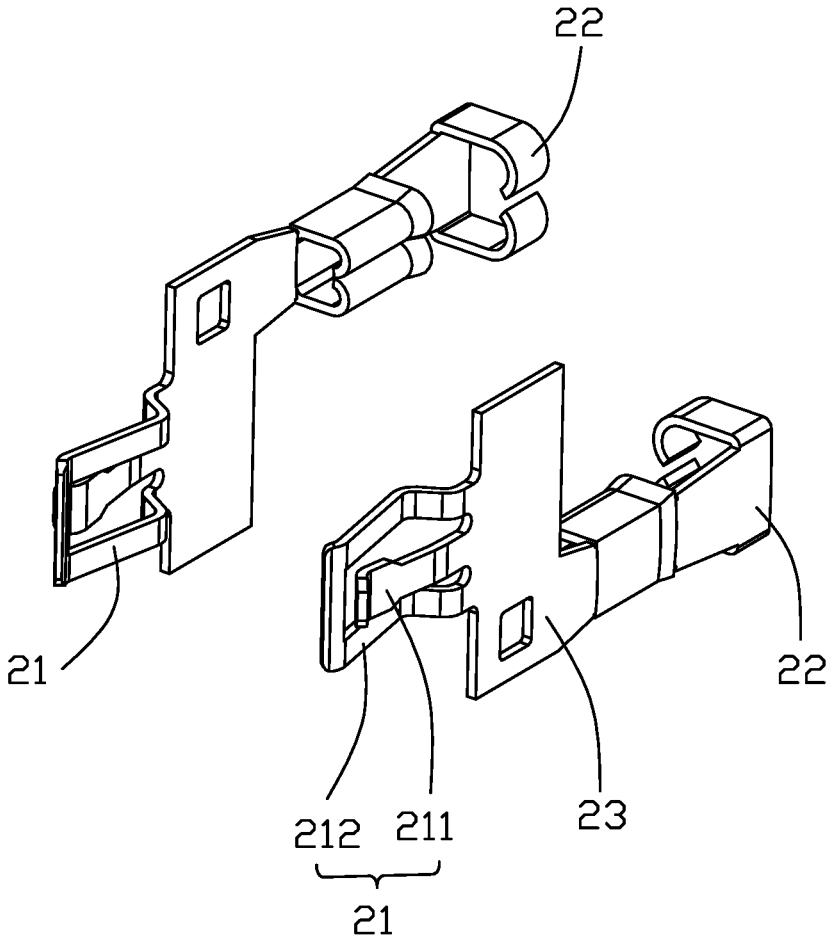
FIG. 16 is the perspective view of the paired receptacle contacts of the receptacle connector of the electrical connector assembly of all aforementioned embodiments.

Referring to FIGS. 1-6, a receptacle connector 100 mated with a plug connector 300 to commonly form the electrical connector assembly, includes an insulative housing 10 and a plurality of receptacle contacts 20 retained in the housing 10. The housing 10 includes a base 17 and a mating port 16 extending forwardly from the base 17. The mating port 16 includes an upper wall 11, a lower wall 12 and a plurality of vertical walls 13 extending therebetween in the vertical direction. A passageway 14 is formed between every adjacent two vertical walls 13 and extends forwardly through the front face 160 of the mating port 16 and rearwardly through the rear face of the base 17. The contacts 20 are paired sharing the same structure as shown in FIG. 16. Each contact includes a front contacting section 21 received within the passageway 14, and a rear connecting section 22 for connecting to the corresponding wire (not shown). The vertical wall 13 includes a plurality of upper recesses 131 around the upper wall 11 to communicate the neighboring passageways 14 located by two sides of the corresponding vertical wall 13. Correspondingly, the upper wall 11 forms a plurality of upper through holes or apertures 111 communicatively aligned, in the vertical direction, with the corresponding upper recesses 131, respectively. Similarly, the vertical wall 13 includes a plurality of lower recesses 132 around the lower wall 12 to communicate the neighboring passageways 14 located by two sides of the corresponding vertical wall 13. Correspondingly, the lower wall 12 forms a plurality of lower through holes 121 communicatively aligned, in the vertical direction, with the corresponding lower recesses, respectively. Therefore, a heat dissipation path B1 is formed by the upper through holes 111, the upper recesses 131, the lower recesses 132 and the lower through holes 121 to communicate the passageway 14 with an outside of the housing 10.

Figure 1:
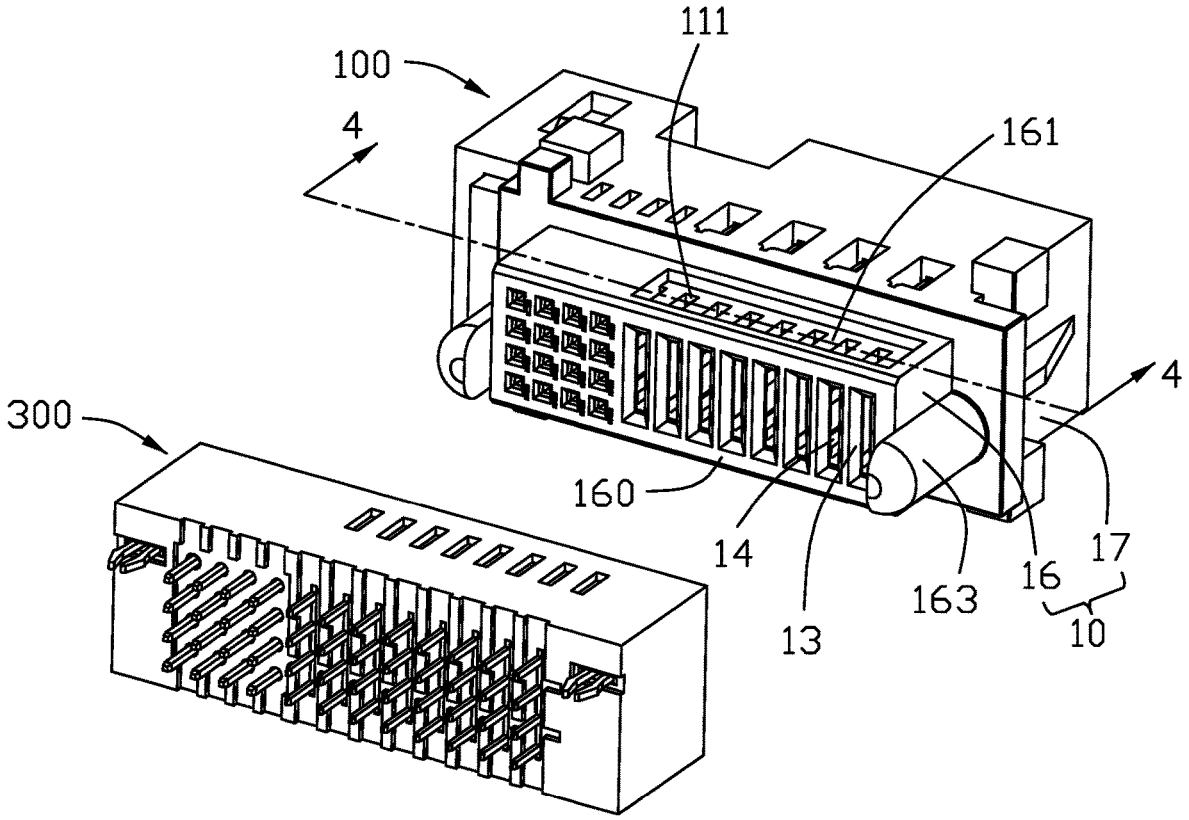
FIG. 1 is a perspective view of an electrical connector assembly including the plug connector and the receptacle connector separated from each other.
Figure 2:
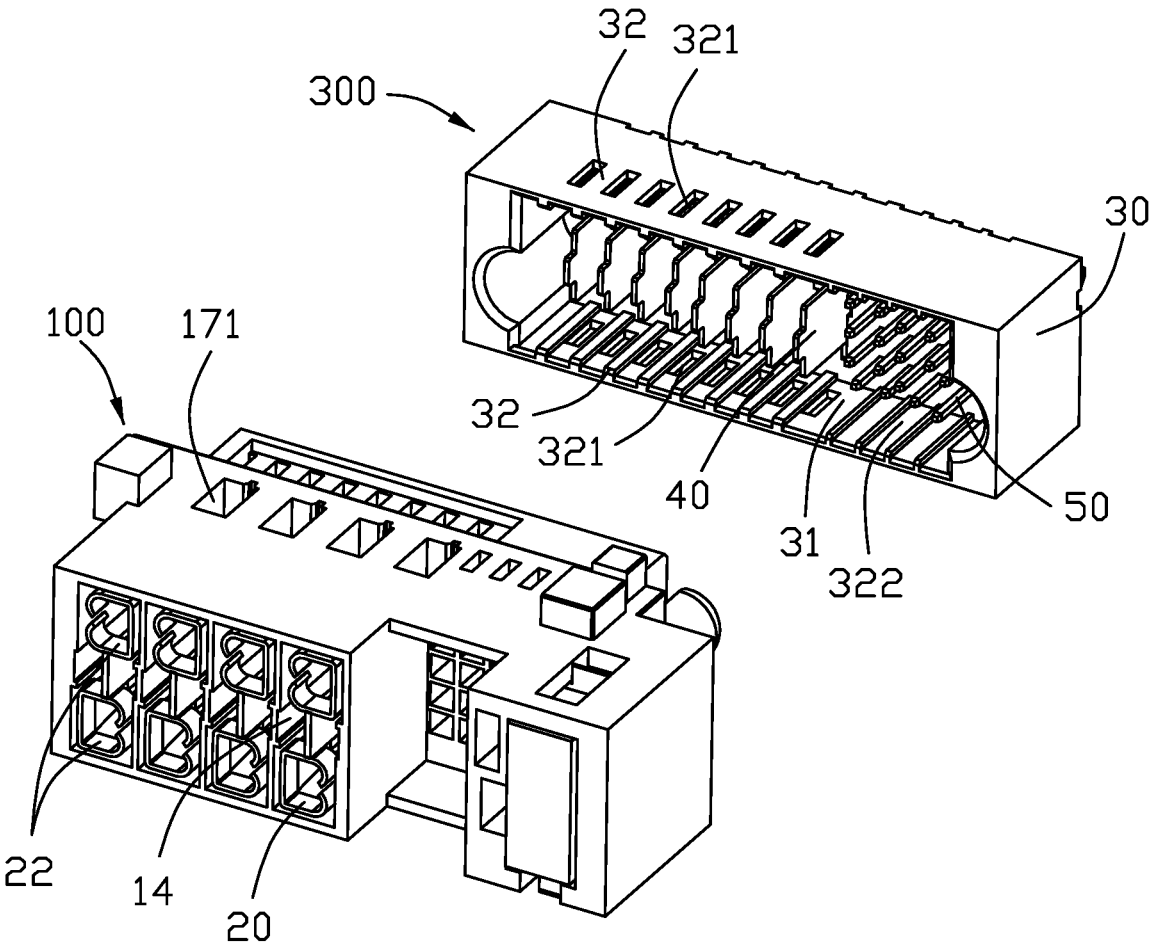
FIG. 2 is another perspective view of the electrical connector assembly of FIG. 1.
Figure 3:
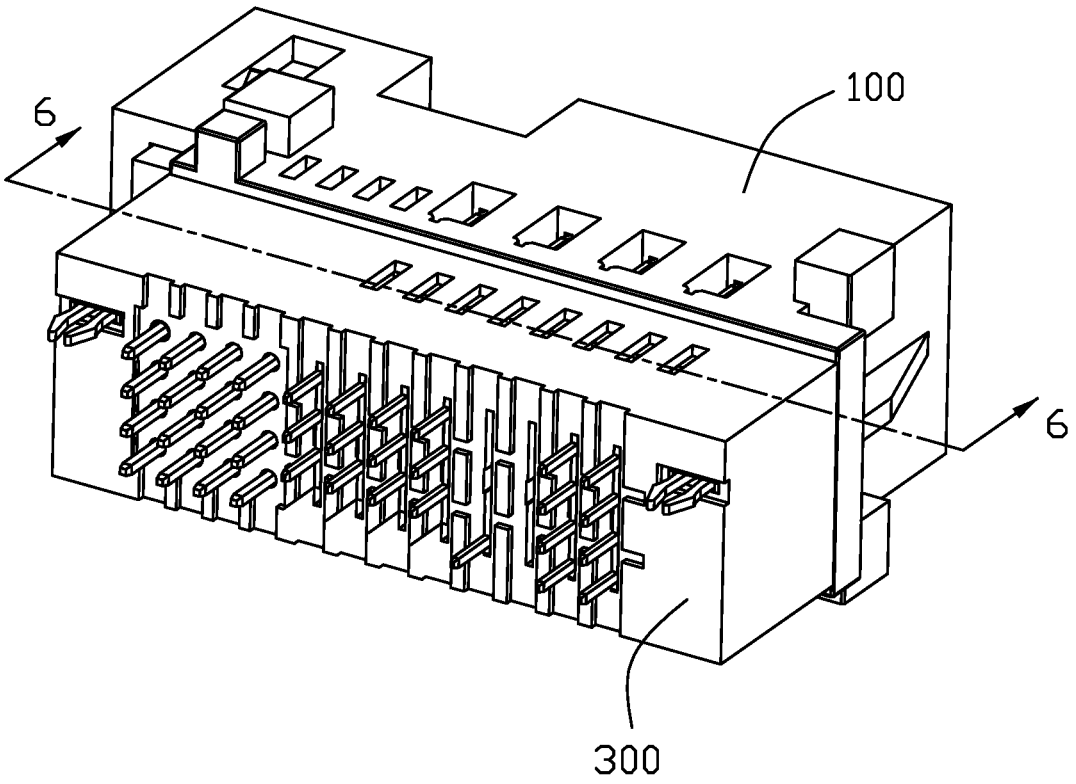
FIG. 3 is a perspective view of the electrical connector assembly of FIG. wherein the plug connector and the receptacle connector are mated with each other.
Figure 4:
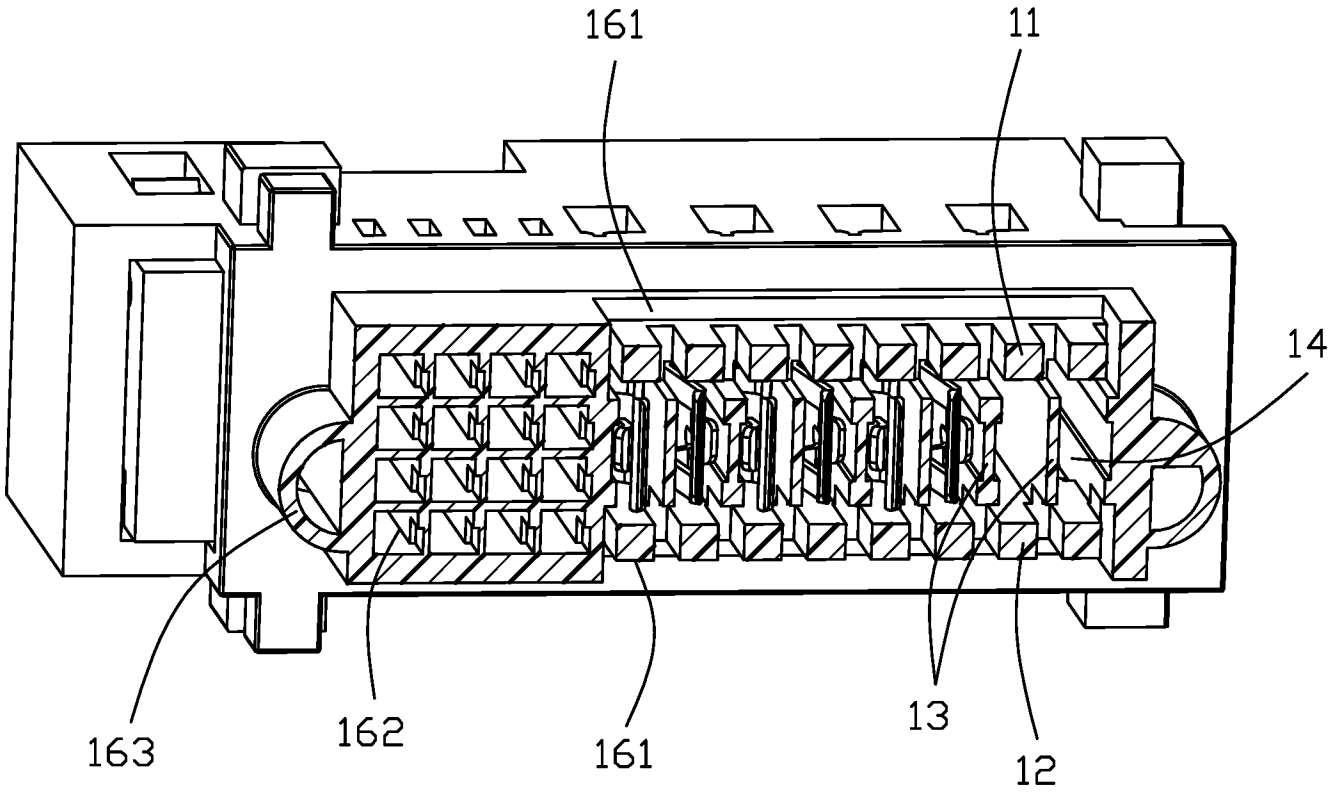
FIG. 4 is a cross-sectional perspective view of the receptacle connector of the electrical connector assembly of FIG. 1 along line 4-4 with a portion thereof being removed therefrom.
Figure 5:
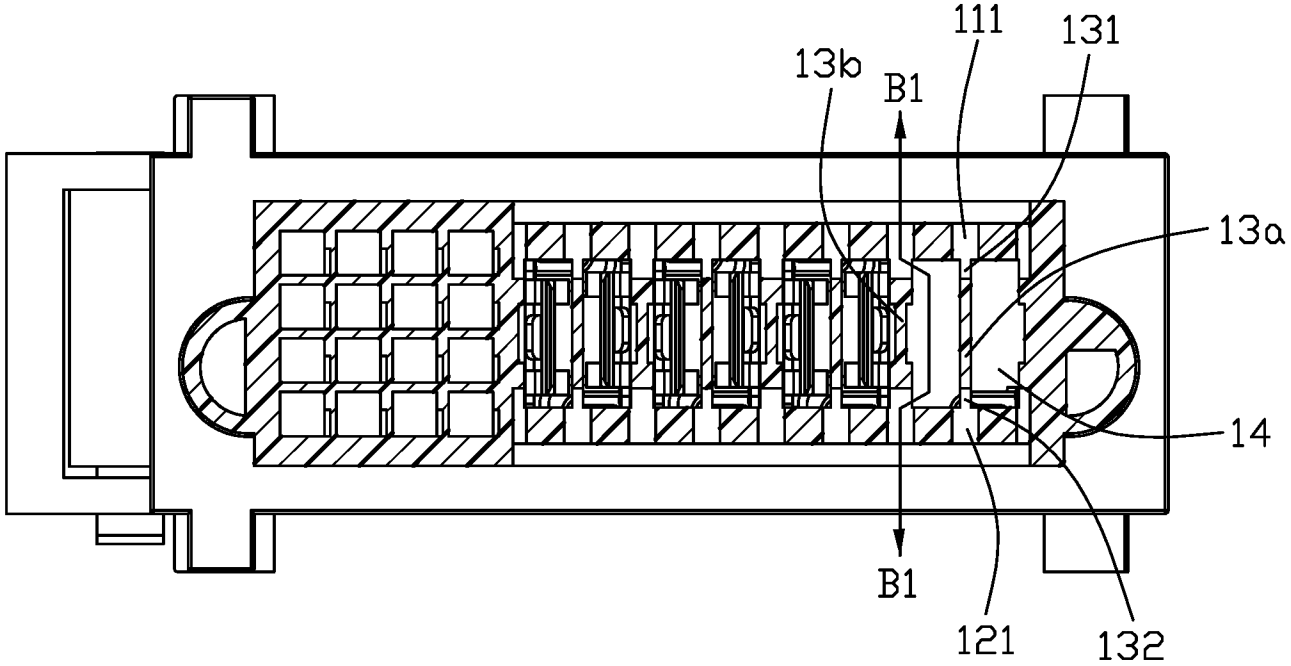
FIG. 5 is an elevational cross-sectional view of the receptacle connector of the electrical connector assembly of FIG. 4.
Figure 6:
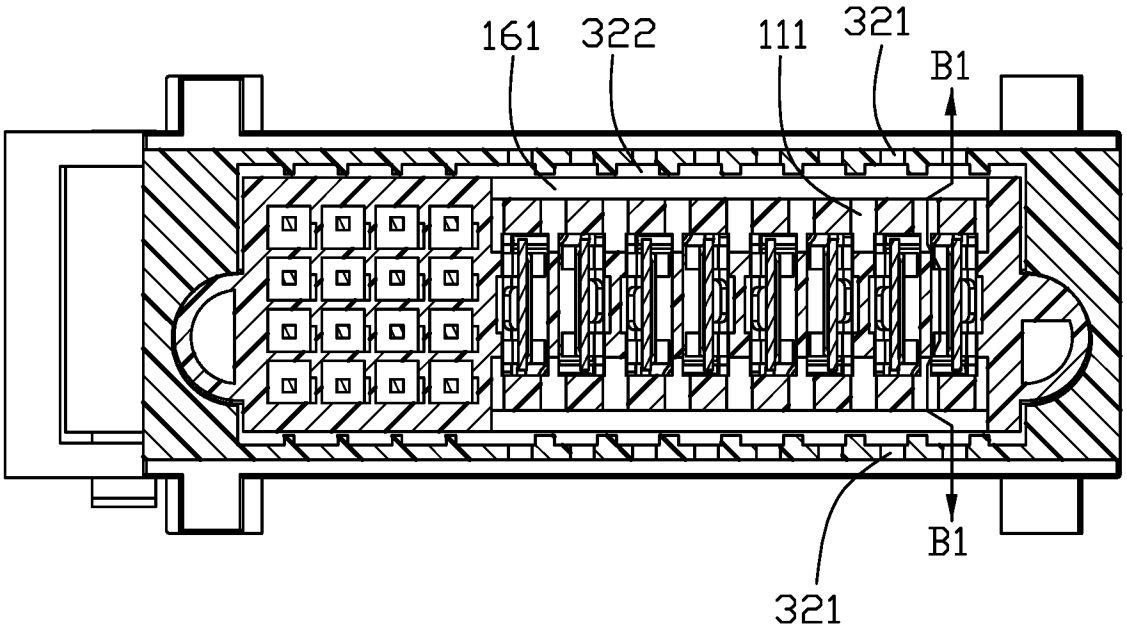
FIG. 6 is a cross-sectional view of the electrical connector assembly of FIG. 3 along line 6-6.

The plug connector 300 includes an insulative box-like body 30 and a plurality of blade-like plug contacts 40 retained therein. The body 30 forms a receiving cavity 31 to receive the mating port 16 of the receptacle connector 100. The contact 40 are side by side arranged with one another in the longitudinal direction in the receiving cavity 31. The body 30 includes opposite top and bottom walls 32 each having a plurality of through openings 321 aligned, in the vertical direction, with the corresponding contacts 40, respectively. As shown in FIG. 6, when mated, the heat dissipation path B1 passes the corresponding through openings 321 so as to expel heat from the inner passageway 14 to an exterior.

Notably, in a standalone receptacle connector 100, the upper through holes 111, the upper recesses 131, the lower recesses 132 and the lower through holes 121 are essentially offset from the corresponding passageways 14, thus avoiding the dust-contamination into the passageway 14, advantageously.

In this embodiment, the mating port 16 forms an indentation 161 in exterior surfaces of the upper wall 11 and the lower wall 12 so as to expose the corresponding upper through holes 111 and lower through holes 121. A shown in FIG. 5, the vertical walls 13 includes a plurality of first type vertical walls 13*a* and a plurality of second type vertical walls 13*b* alternately arrange with each other in the longitudinal direction wherein the second type vertical wall 13*b* is thicker than the first type vertical wall 13*a*. As shown in FIG. 6, the body 30 forms a plurality of grooves 322 in the opposite top and bottom walls 32 to communicate with the corresponding through openings 321. Understandably, during mating, the indentation 161 of the receptacle connector 100 and the grooves 322 of the plug connector 300 facilitate heat transferring between the through holes 111, 121 of the receptacle connector 100 and the through openings 321 of the plug connector 300.

In this embodiment, the passageway 14 further forms an front opening 162 in the front face 160 of the mating port 16 for allowing the contact 40 of the plug connector 300 to be inserted into the corresponding passageway 14. A pair of guiding posts 163 are formed at two opposite ends of the mating port 16. The base 17 includes holes 171 corresponding to the passageways 14 for heat dissipation.

Figure 7:
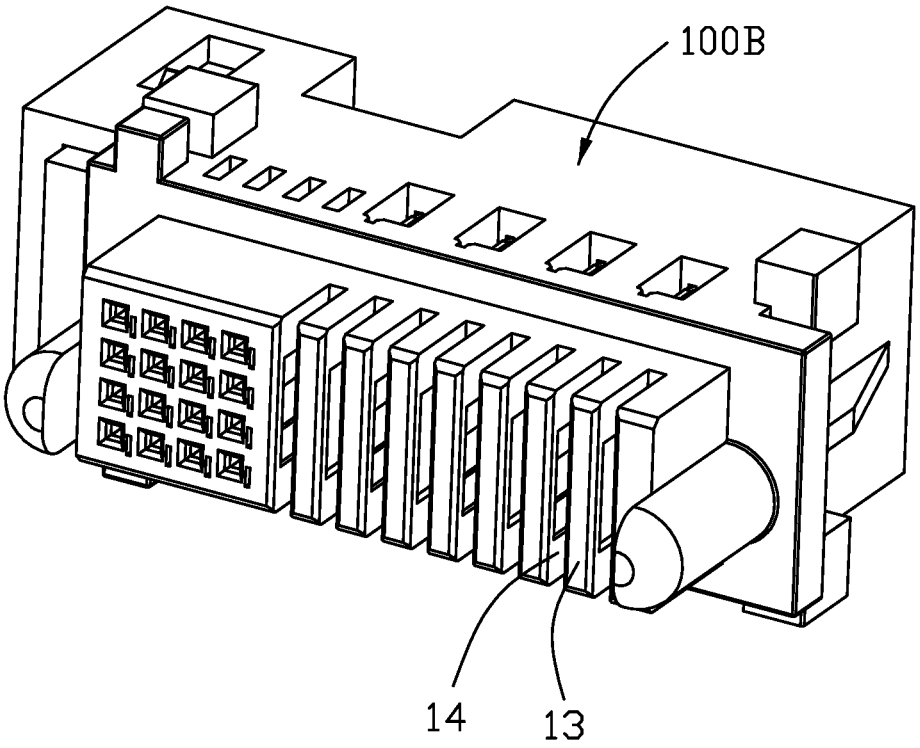
FIG. 7 is a perspective view of the receptacle connector of the electrical connector assembly according to a second embodiment of the invention.
Figure 8:
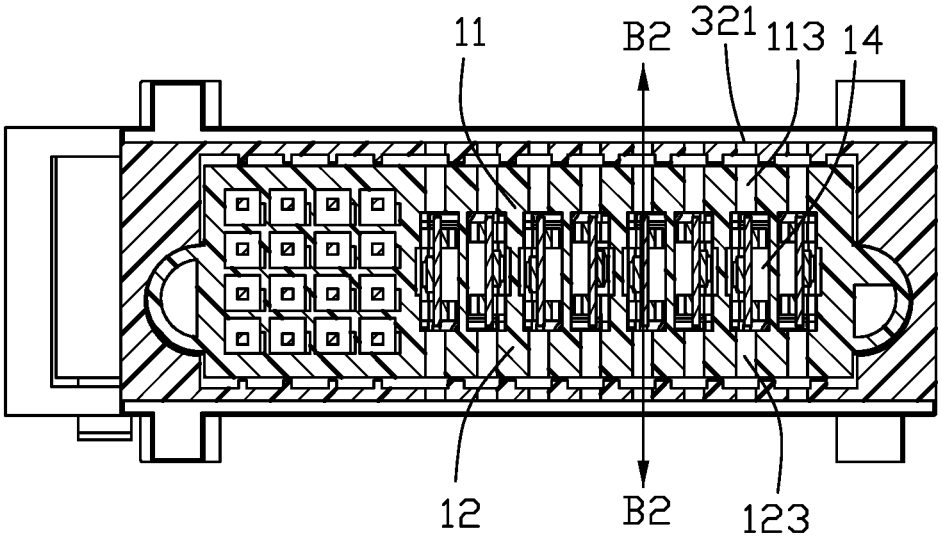
FIG. 8 is a cross-sectional view of the electrical connector assembly with the receptacle connector of FIG. 7 and the plug connector of FIG. 1.

As shown in FIGS. 7-8, the receptacle connector 100B according to the second embodiment of the invention includes the upper through holes 113 aligned with the passageway 14 as well as the lower through holes 123 so as to form the heat dissipation path B2 without offset structure but in a straight manner in the vertical direction. The dimension of the upper through holes 113 and the lower through holes 123 are slightly smaller than that of the passageway 14.

Figure 9:
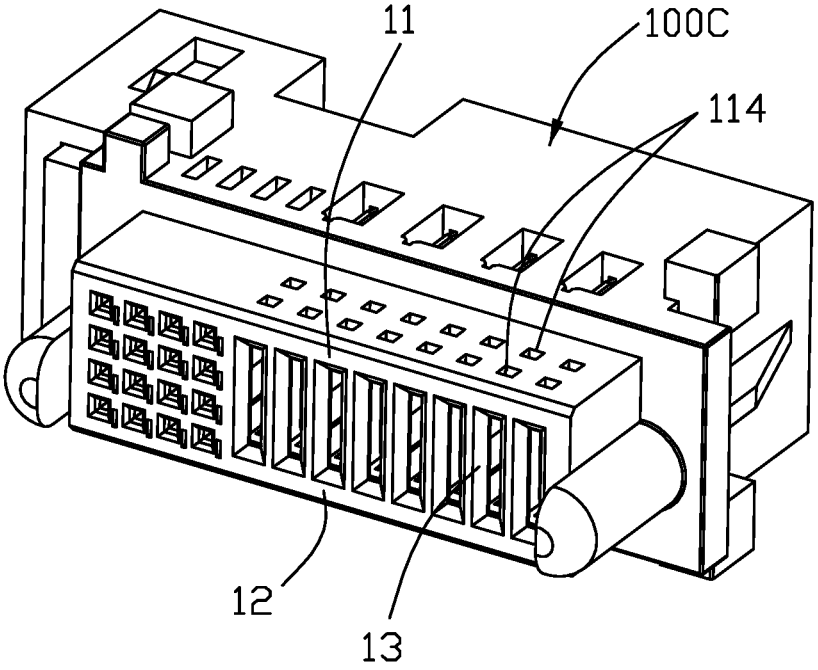
FIG. 9 is a perspective view of the receptacle connector of the electrical connector assembly according to a third embodiment of the invention.
Figure 10:
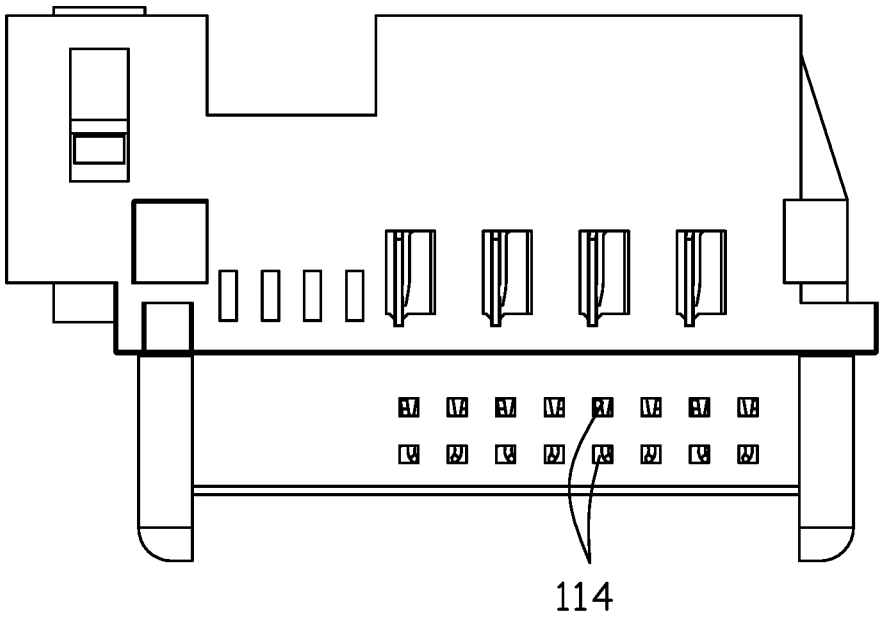
FIG. 10 is a top view of the receptacle connector of the electrical connector assembly of FIG. 9.
Figure 11:
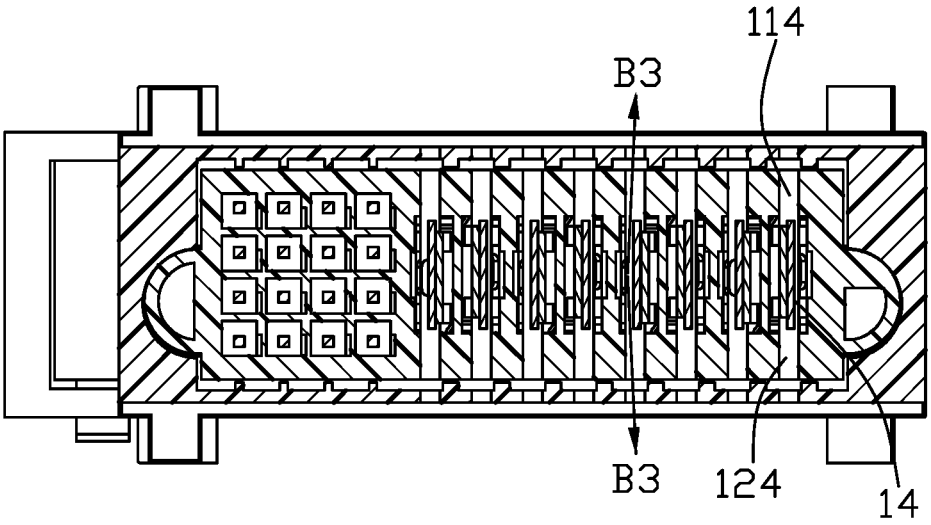
FIG. 11 is a cross-sectional view of the electrical connector assembly with the receptacle connector of FIG. 9 and the plug connector of FIG. 1.

As shown in FIGS. 9-11 according to the third embodiment of the invention, the receptacle connector 100C is similar to the receptacle connector 100B except that each upper through hole 113 is divided into two discrete through holes 114 as well as the lower through hole 132 to form the heat dissipation path B3.

Figure 12:
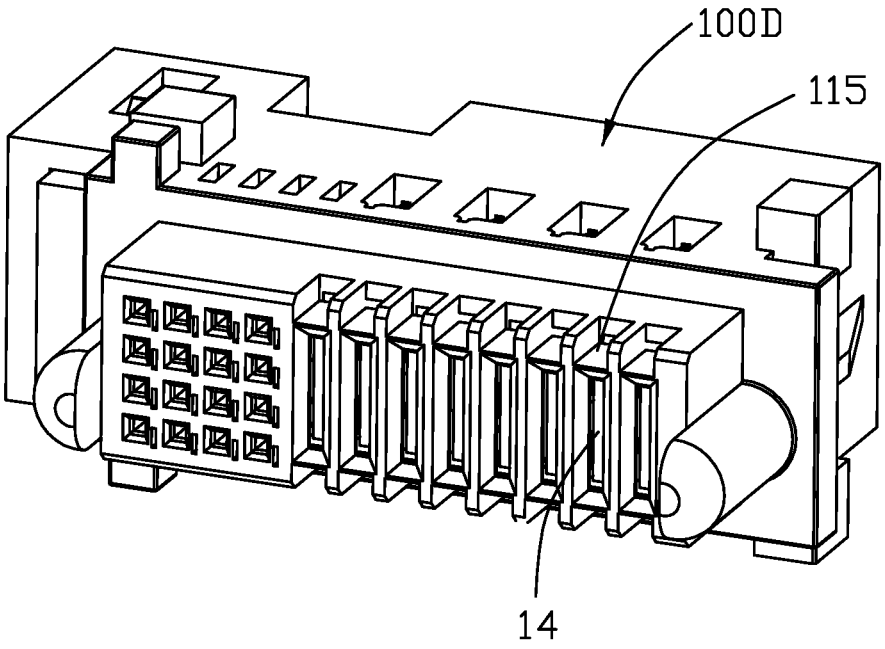
FIG. 12 is a perspective view of the receptacle connector of the electrical connector assembly according to a fourth embodiment of the invention.
Figure 13:
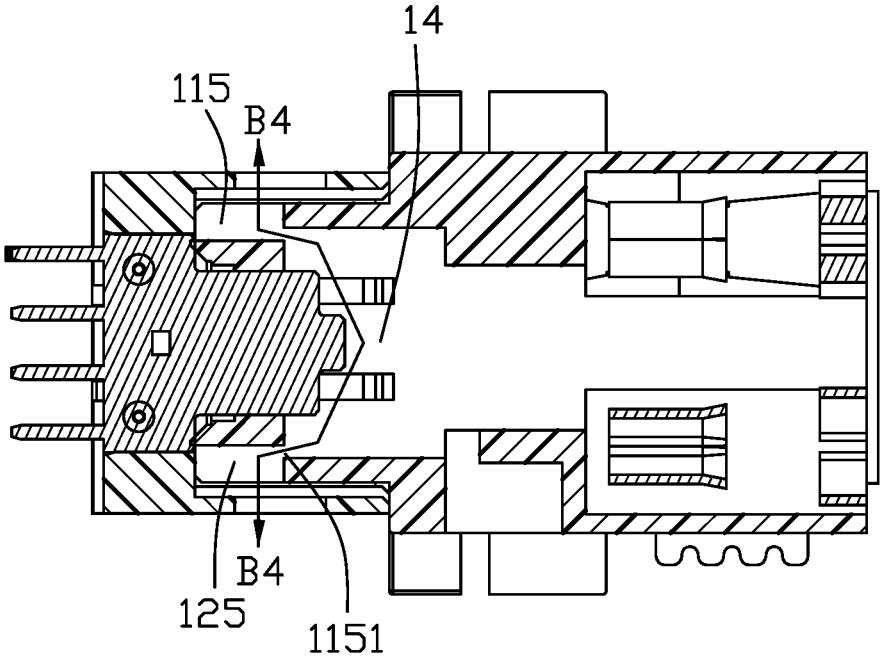
FIG. 13 is a cross-sectional view of the electrical connector assembly with the receptacle connector of FIG. 12 and the plug connector of FIG. 1.

As shown in FIGS. 12-13 according to the fourth embodiment of the invention, the receptacle connector 100D includes in the upper wall 11 as well as the lower wall 12, a plurality of recessions or apertures 115 not communicating with the corresponding passageway 14 in the vertical direction but rearwardly in a front-to-back direction via passageways 1151 so as to form the heat dissipation path B4.

Figure 14:
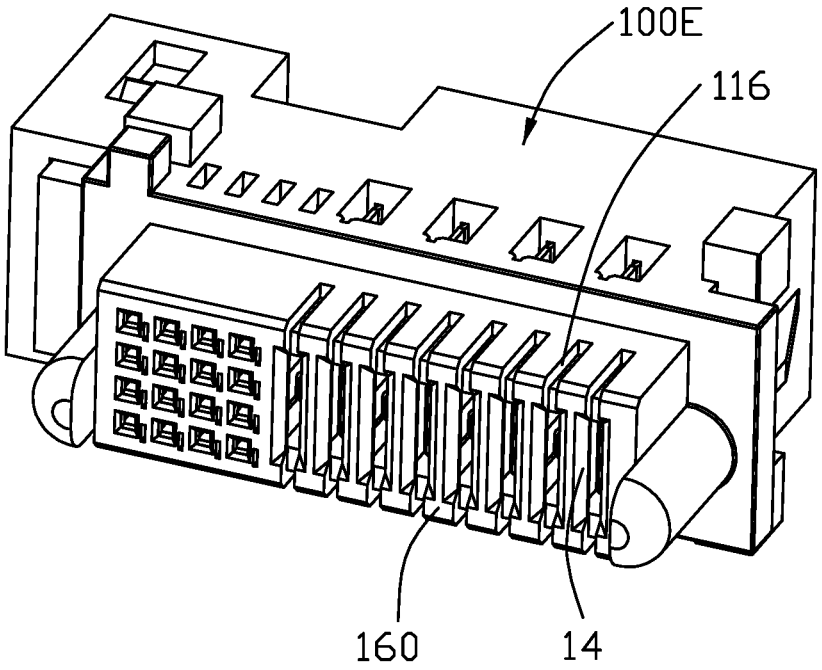
FIG. 14 is a perspective view of the receptacle connector of the electrical connector assembly according to a fifth embodiment of the invention.
Figure 15:
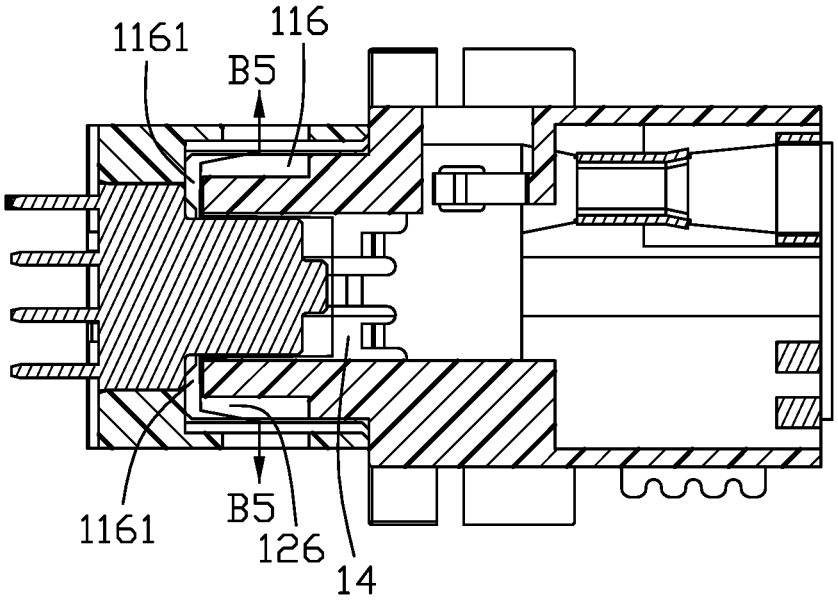
FIG. 15 is a cross-sectional view of the electrical connector assembly with the receptacle connector of FIG. 14 and the plug connector of FIG. 1.

As shown in FIGS. 14-15 according to the fifth embodiment of the invention, the receptacle connector 100E includes in the upper wall 11 as well as the lower wall 12, a plurality of recessions 116 not communicating with the corresponding passageways 14 directly in the vertical direction but forwardly and downwardly via passages 1161 in the front face 160 so as to form the heat dissipation patch B5.

Figure 17:
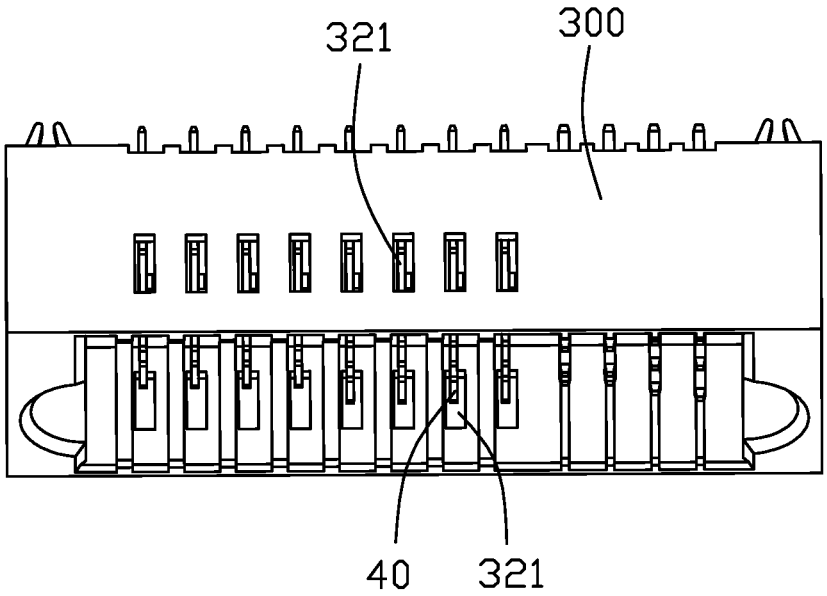
FIG. 17 is a perspective view of the plug connector of the electrical connector assembly of all aforementioned embodiments.
Figure 18:
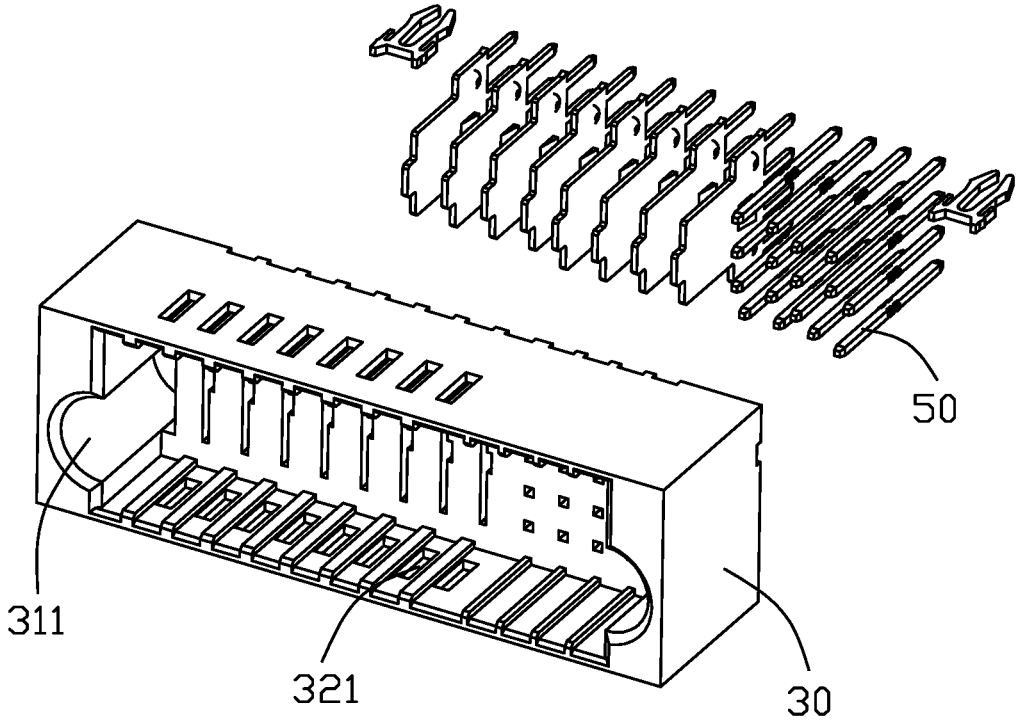
FIG. 18 is an exploded perspective view of the plug connector of the electrical connector assembly of FIG. 17.

FIG. 16 shows the contacts 20 in pair. Each contact 20 includes a retaining section 23 for retaining to the housing 10, the contacting section 21 extending forwardly from the retaining section 23 for mating with the contact 40, the connecting section 22 extending rearwardly from the retaining section 23 for connecting to the wire (not shown). The contacting section 21 includes a first part 211 and a second part 212 to sandwich the corresponding contact 40 therebetween during mating. The connecting sections 23 of the paired contacts 20 are arranged in the vertical direction for saving space. FIGS. 17-18 show the plug connector 300 wherein the contacts 40 are aligned with the corresponding through openings 321, respectively, a plurality of pin type contacts 50 are located by the contacts 40, and the pair of guiding channels 311 are located by two ends to receive the corresponding guiding posts 163, Although the present invention has been described with reference to particular embodiments, it is not to be construed as being limited thereto. Various alterations and modifications can be made to the embodiments without in any way departing from the scope or spirit of the present invention as defined in the appended claims. Understandably, in the embodiments the mating direction is defined to be the front-to-back direction. Anyhow, the mating direction may be defined as the vertical direction. Under such a situation, the upper/top wall and the lower/bottom wall are changed to be the left and the right side walls in a transverse direction perpendicular to the longitudinal direction and the vertical direction. In other words, the orientation of the electrical connector assembly depends upon the viewpoint of the user and should not be in a fixed manner.

What is claimed is:

1. An electrical connector assembly comprising:

a receptacle connector including:

an insulative housing defining a mating port having an upper wall and a lower wall both extending along a longitudinal direction and opposite to each other in a vertical direction perpendicular to the longitudinal direction;

a plurality of vertical walls linked between the upper wall and the lower wall to form corresponding passageways alternately arranged with the vertical walls in the longitudinal direction;

a plurality of receptacle contacts disposed in the corresponding passageways, respectively; and a plurality of upper through holes formed in the upper wall and aligned, in the vertical direction, with the corresponding vertical walls, respectively;

wherein each upper through hole communicates with the two passageways located by two sides of the corresponding vertical wall.

2. The electrical connector assembly as claimed in claim 1, wherein each vertical wall further forms an upper recess around the upper wall so as to communicate said two passageways located by two sides thereof in the longitudinal direction.

3. The electrical connector assembly as claimed in claim 2, wherein the upper wall further forms an indentation in an exterior surface to communicate with all the upper through holes.

4. The electrical connector assembly as claimed in claim 3, further including a plug connector mated with the receptacle connector, wherein said plug connector includes an insulative body defining a mating cavity to receive the mating port of the receptacle connector and including opposite top wall and bottom wall respectively covering the upper wall and lower wall of the receptacle connector in the vertical direction, and the top wall of the plug connector forms a plurality of upper through openings communicating with the indentation in the vertical direction.

5. The electrical connector assembly as claimed in claim 4, wherein the upper through openings of the plug connector are not aligned with the corresponding through holes of the receptacle connector in the vertical direction but being offset therefrom in the longitudinal direction.

6. The electrical connector assembly as claimed in claim 4, wherein the top wall of the plug connector further includes a plurality of grooves in an inner face to communicate the corresponding through openings of the top wall of the plug connector and the indentation of the upper wall of the receptacle connector.

7. The electrical connector assembly as claimed in claim 6, wherein a dimension of the groove is larger than that of the corresponding top opening in the longitudinal direction.

8. The electrical connector assembly as claimed in claim 4, wherein the plug connector includes a plurality of blade type contacts retained to the insulative body and aligned, in the vertical direction, with the corresponding through openings, respectively.

9. The electrical connector assembly as claimed in claim 1, wherein a dimension of the upper through hole is slightly larger than that of the corresponding vertical wall in the longitudinal direction.

10. An electrical connector assembly comprising:

a receptacle connector including:

an insulative housing defining a mating port having an upper wall and a lower wall both extending along a longitudinal direction and opposite to each other in a vertical direction perpendicular to the longitudinal direction;

a plurality of vertical walls linked between the upper wall and the lower wall to form corresponding passageways alternately arranged with the vertical walls in the longitudinal direction;

a plurality of receptacle contacts disposed in the corresponding passageways, respectively; and a plurality of upper recessions formed in an exterior face of the upper wall and aligned, in the vertical direction, with the corresponding passageways, respectively; wherein each upper recession does not directly communicate with the corresponding passageways in the vertical direction but via assistance of a passage in a front-to-back direction perpendicular to both the longitudinal direction and the vertical direction.

11. The electrical connector assembly as claimed in claim 10, further including a plug connector mated with the receptacle connector, wherein said plug connector includes an insulative body defining a mating cavity to receive the mating port of the receptacle connector and including opposite top wall and bottom wall respectively covering the upper wall and lower wall of the receptacle connector in the vertical direction, and the top wall of the plug connector forms a plurality of upper through openings communicating with the corresponding recessions in the vertical direction, respectively.

12. The electrical connector assembly as claimed in claim 11, wherein the top wall of the plug connector further includes a plurality of grooves in an inner face to communicate the corresponding through openings of the top wall of the plug connector and the upper recessions of the upper wall of the receptacle connector.

13. The electrical connector assembly as claimed in claim 12, wherein a dimension of the groove is larger than that of the corresponding top opening in the longitudinal direction.

14. An electrical connector assembly comprising:

a receptacle connector and a plug connector adapted to be mated with each other in a front-to-back direction, the receptacle connector including:

an insulative housing defining a mating port having an upper wall and a lower wall both extending along a longitudinal direction perpendicular to the front-to-back direction, and opposite to each other in a vertical direction perpendicular to both the front-to-back direction and the longitudinal direction;

a plurality of vertical walls linked between the upper wall and the lower wall to form corresponding passageways alternately arranged with the vertical walls in the longitudinal direction;

a plurality of receptacle contacts disposed in the corresponding passageways, respectively;

a plurality of upper apertures formed in the upper wall and communicating with the corresponding passageways thereunder; and the plug connector including an insulative body defining a mating cavity to receive the mating port of the receptacle connector and including opposite top wall and bottom wall respectively covering the upper wall and lower wall of the receptacle connector in the vertical direction, and the top wall of the plug connector forms a plurality of upper through openings and a plurality of grooves in an interior face thereof to communicate the through openings with the corresponding upper apertures, respectively.

15. The electrical connector assembly as claimed in claim 14, wherein a dimension of the groove is larger than that of the corresponding through opening and that of the corresponding aperture in the longitudinal direction.

16. The electrical connector assembly as claimed in claim 14, wherein the upper wall of the receptacle connector forms an indentation in an exterior face to communicate the upper apertures of the receptacle connector with the corresponding upper openings of the plug connector.

17. The electrical connector assembly as claimed in claim 16, wherein the upper aperture extends through the upper wall in the vertical direction.

18. The electrical connector assembly s claimed in claim 16, wherein the upper apertures are respectively aligned with the corresponding vertical walls in the vertical direction.

* * * * *